US007027282B2

(12) United States Patent
Ryhänen et al.

(10) Patent No.: US 7,027,282 B2
(45) Date of Patent: Apr. 11, 2006

(54) METHOD AND ARRANGEMENT FOR CONTROLLING MICROMECHANICAL ELEMENT

(75) Inventors: Tapani Ryhänen, Helsinki (FI); Vladimir Ermalov, Helsinki (FI)

(73) Assignee: Nokia Mobile Phones, Ltd., Espoo (FI)

( * ) Notice: Subject to any disclaimer, the term of this patent is extended or adjusted under 35 U.S.C. 154(b) by 571 days.

(21) Appl. No.: 09/834,198

(22) Filed: Apr. 12, 2001

(65) Prior Publication Data

US 2002/0066659 A1 Jun. 6, 2002

(30) Foreign Application Priority Data

Apr. 13, 2000 (FI) ..... 20000888

(51) Int. Cl.
*H01H 47/00* (2006.01)

(52) U.S. Cl. ..... 361/139

(58) Field of Classification Search ..... 361/139, 361/233, 56, 277; 333/262; 358/18; 307/112–150; 359/254; 200/181; 310/309; 385/16
See application file for complete search history.

(56) References Cited

U.S. PATENT DOCUMENTS

| | | | | |
|---|---|---|---|---|
| 3,387,194 A * | 6/1968 | Banks | 318/139 |
| 4,356,730 A | 11/1982 | Cade | 73/517 |
| 4,959,515 A | 9/1990 | Zavracky et al. | 200/181 |
| 5,233,459 A | 8/1993 | Bozler et al. | 359/230 |
| 5,638,946 A | 6/1997 | Zavracky | 200/181 |
| 5,784,189 A * | 7/1998 | Bozler et al. | 359/254 |
| 5,943,223 A * | 8/1999 | Pond | 363/53 |

FOREIGN PATENT DOCUMENTS

| | | |
|---|---|---|
| EP | 04058429 | 2/1992 |
| EP | 0478956 A2 | 4/1992 |
| WO | WO 95/01624 | 1/1995 |
| WO | WO 98/34269 | 8/1998 |

OTHER PUBLICATIONS

IBM Technical Disclosure Bulletin, vol. 30, No. 6, Nov. 1987, p. 393.
IBM Technical Disclosure Bulletin, vol. 36, No. 07, Jul. 1993 p. 45.
Patent Abstract of Japan, Publication No. 04058429, Feb. 25, 1992, for Matsushi.

* cited by examiner

*Primary Examiner*—Brian Sircus
*Assistant Examiner*—James A. Demakis
(74) *Attorney, Agent, or Firm*—Perman & Green, LLP.

(57) ABSTRACT

The invention relates to a controlling of micromechanical elements. Especially the invention relates to the controlling of the micromechanical switches. According to a method for controlling at least one micromechanical element a first control signal and a second control signal are fed to the micromechanical element. The second control signal is arranged to set the micromechanical element to an active state and the first control signal is arranged to hold the micromechanical element in the active state. An arrangement for controlling at least one micromechanical element (402) contains at least means for generating at least a first control signal and a second control signal, means for raising a voltage level of at least the second control signal and means for feeding the first control signal and the second control signal with raised voltage level to the micromechanical element. By means of the invention lower voltage levels can be used in micromechanical applications.

38 Claims, 13 Drawing Sheets

Fig. 5e
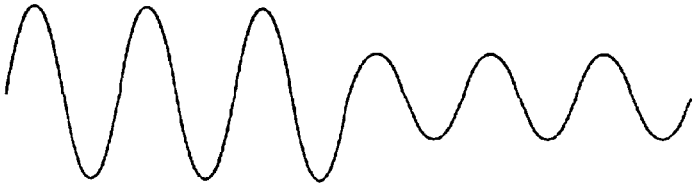
Fig. 5f
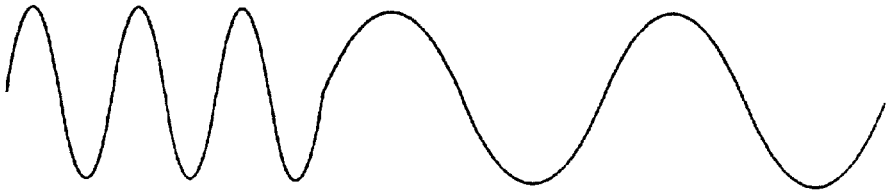
Fig. 5g
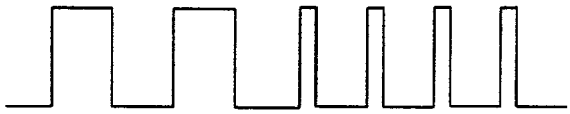
Fig. 5h
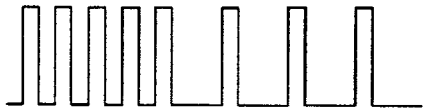
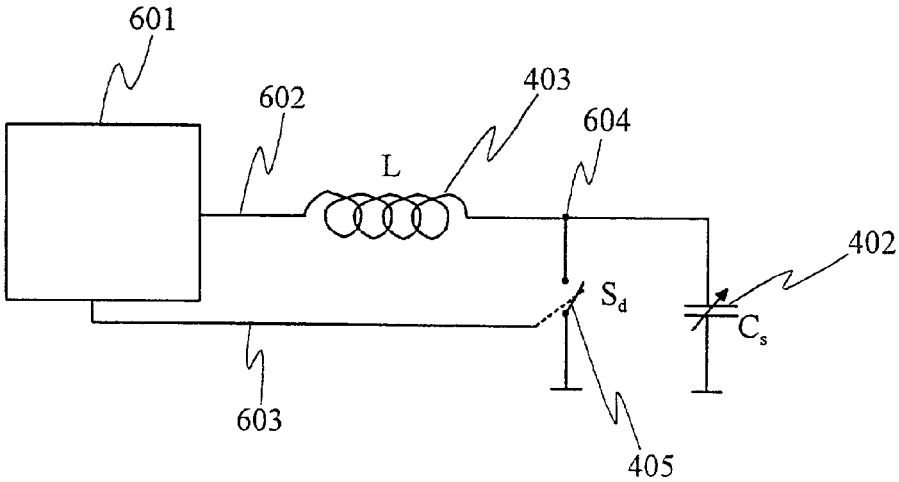
Fig. 6a

METHOD AND ARRANGEMENT FOR CONTROLLING MICROMECHANICAL ELEMENT

BACKGROUND OF THE INVENTION

1. Field of the Invention

The invention relates to micromechanical elements. Especially, the invention relates to controlling micromechanical elements such as micromechanical capacitive or galvanic switches or microrelays, micromechanical optical switches, bi-stable tunable capacitors or capacitor banks, or any other bi-stable or multi-state micromechanical actuators.

2. Micromechanical Elements

In microelectronics the trend is towards a higher level of integration. The same is happening in micromechanics as well. Consequently, micromechanical elements designated especially for microelectronic purposes need to be more highly integrated because of the requirement for smaller and smaller components for electrical applications. By using micromechanical elements, such as micromechanical switches or microrelays, many advantages can be achieved. For example, the size of the devices becomes smaller and the manufacturing costs become lower. There are also other advantages as will be demonstrated later.

In the following micromechanical switches are presented more closely. Micromechanical switches belong to the field of micromechanical elements, which will be widely used in many future applications. Micromechanical switches create interesting opportunities, e.g. for radio frequency circuits. The advantages of using micromechanical structures, especially when applied to radio frequency circuits, are low insertion loss (below 0.5 dB) and high isolation (over 30 dB). A further advantage of micromechanical switches is that micromechanical switch structures can be integrated monolithically in integrated circuits. FIGS. 1*a–c* show three different commonly used basic structures of micromechanical switches. In FIG. 1*a* it is shown so called micromechanical cantilever switch. In FIG. 1*b* it is shown a micromechanical cantilever switch that connects sections of a transmission line. FIG. 1*c* illustrates a micromechanical bridge switch.

The operation of a micromechanical switch is controlled with a control signal or signals, coupled to electrodes of the switch. By means of the control signal the micromechanical switch is arranged to change its state. The main disadvantage of the currently available micromechanical switches operated by electrostatic or voltage control is that the necessary control voltage tends to be in the range of 10–30 V. This kind of voltage is much higher than the supply voltage used in state-of-the-art (Bi)CMOS devices used for switching operations. Furthermore, the switching delay and necessary control voltage level are fundamentally related to each other in that a faster switching time requires a higher mechanical resonance frequency and thus a stiffer mechanical structure. Stiffer mechanical structures will however make higher control voltage levels necessary.

3. The Theory of Switching Dynamics in Micromechanical Switches

In micromechanical elements, especially in micromechanical switches, the switching characteristics and behavior resembles classical mechanical relays in many senses. For this reason the operation of micromechanical switches are modeled with simplified piston models.

The electrostatic force between the capacitor plates of a plate capacitor is $$F = -\frac{\partial W}{\partial x} = -\frac{\partial}{\partial x}\left(\frac{1}{2}CU^2\right) = -\frac{\partial}{\partial x}\left(\frac{Q^2}{2C}\right) \Leftrightarrow \quad (1)$$

$$F = \frac{\varepsilon_0 A U^2}{2(g_0 - x)^2} = \frac{Q^2}{2\varepsilon_0 A}.$$

Here W is the energy stored in the capacitance C, U is the voltage difference, Q is the charge, x is the displacement, and $g_o$ is the original gap between the capacitor plates.

In FIG. 2 is shown a simplified piston type model for a micromechanical switch. This consists of a mass, a spring, a damper, a plate capacitor structure, and optional insulating motion limiters 203. When an electrostatic force is applied between the fixed electrode 202 and the moving part 201 of the piston type structure, an electrostatic attractive force is created between the electrodes. A force balance between the mechanical spring force and the electrostatic force is created:

$$\sum F = F_{electric} + F_{mechanical} = \frac{\varepsilon_0 A U^2}{2(g_0 - x)^2} - \kappa x = 0, \quad (2)$$

where $g_0$ is the original gap between the capacitor plates, x is the displacement from the rest position, U is the electric potential difference between the capacitor plates, κ is the spring constant, A is the capacitor area, and $\epsilon_0$ is the dielectric constant.

The model of FIG. 2 is a good approximation of a voltage controlled micromechanical capacitor, switch or relay. The system is instable when the mechanical force cannot any longer sustain the electrical force. This will occur when both the sum of the forces (ΣF ) and the sum of the derivatives of the forces $$\left(\frac{\partial}{\partial x}\left(\sum F\right)\right)$$

are zero.

The pull-in or the collapse of the piston structure occurs independently of the dimensions of the structure when the deflection is $$x = g_0/3, \quad (3)$$

and when the voltage is $$U_{pull\text{-}in} = \sqrt{\frac{8\kappa g_0^3}{27\varepsilon_0 A}}. \quad (4)$$

As can be seen from FIG. 2 insulating bumps 203 can be arranged on the electrode 202 to limit the minimum distance between the electrodes at pull-in.

After the collapse the gap is reduced to a value determined by the height $h_{bump}$ of these mechanical limiters on the surface of the fixed electrode. In order to release the switch, the voltage between the electrodes must be reduced to a value where the mechanical force can again compensate the electrical force. Thus we can find the value of the release voltage $$U_{release} = \sqrt{\frac{2 \cdot \kappa \cdot (g_0 - h_{bump}) \cdot h_{bump}^2}{\varepsilon_0 A}}. \quad (5)$$

The release voltage is clearly smaller than the pull-in voltage. For example, for 100 nm high limiters, the release voltage is roughly 10% of the pull-in voltage. Thus even if a high voltage is needed for causing pull-in, a much lower voltage is needed to keep the electrode in the pulled-in state.

FIG. 3*a* illustrates the typical voltage-to-deflection characteristics of a micromechanical switch. The movable structure deflects towards the fixed electrode until the pull-in happens. When the voltage is lowered below the release voltage, the structure relaxes back to the equilibrium position between the mechanical and electrostatic forces. In general, structures with multiple states can be designed as well. FIG. 3*b* illustrates an example of a system with two different stable pull-in states, a first active (closed) state 306 and second active (closed) state 307.

Equation (1) implies that if the charge of the capacitor can be controlled instead of the voltage across the capacitor, the pull-in instability can be avoided because the force generated by a constant charge is not dependent on deflection. There are several implementations known in literature to achieve charge control, and charge control of micromechanical structures are experimentally proven. The advantage is a much larger tuning range.

Instead of constant voltage or constant charge, an AC voltage or current can as well be used to control the deflection of a micromechanical structure. When a sinusoidal current is applied through a capacitor, the charge of the capacitor q behaves as $$\dot{q} = \hat{i}_{ac} \sin\omega_{ac} t \Rightarrow \quad (6)$$

$$q = \frac{\hat{i}_{ac}}{\omega_{ac}}(1 - \cos\omega_{ac} t) + q_0,$$

where $\hat{i}_{ac}$ is the amplitude of the AC current and $\omega_{ac}$ is the frequency. For further analysis, the initial charge $q_0$ can be set to zero. If the frequency of the AC current is higher than the mechanical resonance frequency, the dc component of the force will be $$F_{dc} \approx \frac{\hat{i}_{ac}^2}{2\varepsilon_0 A \omega_{ac}^2}. \quad (7)$$

One simple way to convert the AC voltage signal into an effective AC current is to use a LC tank circuit. Typically the capacitance of a micromechanical element is in the range from 1 pF to 30 pF. The AC voltage input signal is converted into an alternating current through the capacitor. With the help of an LC tank circuit very high amplitude of oscillating current or charge on the capacitor can be achieved. The amplitude of the current depends on the quality factor Q of the LC tank circuit when the tank circuit is resonating. In the preferred implementation, the tank circuit Q value should be over 10.

If the LC tank circuit is applied to switch control, the switching delay of a micromechanical element controlled by an AC signal passed through the inductor depends on several parameters:

$$\tau_{switch} = \tau_{switch}(Q_m, f_0, U_{pull\text{-}in}, U_{control}, f_1, Q_s, f_{LC}) \quad (8)$$

where $f_0$ is the mechanical resonance frequency, $Q_m$ the mechanical quality factor, $U_{pull\text{-}in}$ the pull-in voltage, $f_{LC}$ is the resonance frequency of the LC tank circuit at the initial state with no deflection of the micromechanical element, $Q_s$ the quality factor of the LC tank circuit, and $U_{control}$ and $f_1$ are the level and frequency of the control voltage, respectively.

In order to optimize the switching delay, the mechanical quality factor needs to be compromised to be high enough to give sufficient fast motion but also small enough to damp the switch bouncing after first contact. Optimal value for the mechanical quality factor is roughly 0.05–0.5. This can be adjusted by suitable design of the switch structure and by the pressure of the surrounding gas.

The switching time is inversely proportional to the mechanical resonance frequency. The lower the required switching time, the stiffer the mechanical structure should be. According to Equation (3) this leads to a higher pull-in voltage and a higher voltage level needed to trigger the micromechanical bi-stable element.

The switching delay is also dependent on the amplitude and the frequency of the control signal. In addition, the matching between the tank circuit resonance frequency $f_{LC}$ and the control signal frequency $f_1$ will influence the force and the switching delay. Note that the tank circuit resonance frequency $f_{LC}$ is not constant during the operation of the switch: when the capacitive gap of the micromechanical structure gets narrower, the resonance frequency $f_{LC}$ gets lower and is mismatched from the signal frequency $f_1$.

FIG. 3*c* shows the dependence of the switching delay on the ratio between the electrical ($f_{LC}$) or mechanical ($f_m$) resonance frequencies to the signal frequency $f_1$. The switching delay is shortened by increasing the signal frequency $f_1$. The optimal signal frequency is 100–1000 times higher than the mechanical resonance frequency. FIG. 3*d* shows the dependence of the switching delay on the ratio between the tank circuit resonance frequency $f_{LC}$ and the control signal frequency $f_1$. The minimal switching delay is achieved by setting the control signal frequency $f_1$ roughly 1–3% lower than the initial tank circuit resonance frequency $f_{LC}$.

SUMMARY OF THE INVENTION

The object of the invention is to present a method and an arrangement for controlling micromechanical elements in a practical way. At the same time, the object of the invention is to mitigate the described problems when controlling the operation of micromechanical elements.

The objects of the invention are achieved by using at least two control signals, one of which is used to set the micromechanical element to a active (closed) state and another which is used to hold the micromechanical element in the active (closed) state. The active state is typically a pull-in state.

The objects of the invention can alternatively be achieved by combining the two control signals in a single signal. The advantage of this kind of arrangement is that the voltage level needed to hold the micromechanical element in the pull-in state can be lowered. As a result the power consumption can be minimized and complicated dc-dc converter circuits to create higher voltage levels are not needed. An additional benefit is that the arrangements to receive the advantages of the invention are simple and easy to implement.

The method for controlling at least one micromechanical element is characterized in that the micromechanical element is set to an active state with at least a second control signal, and the micromechanical element is held on said active state with at least a first control signal.

The arrangement for controlling at least one micromechanical element is characterized in that the arrangement comprises at least means for generating at least a first control signal and a second control signal, means for raising a voltage level of at least said second control signal, means for feeding said first control signal and said second control signal with raised voltage level to the micromechanical element.

According to the invention a control circuit is arranged for the micromechanical element. The control circuit comprises at least an arrangement in which at least two control signals are received and at least one output signal is generated. The first control signal is used for holding the state of the micromechanical element, when it is active or in conducting state. The micromechanical element is set to the active state with a second control signal. The second control signal alone or the sum of the first control signal and the second control signal is advantageously such that they cause the micromechanical element to change its state.

Advantageously, the first control signal is a constant voltage signal and the second control signal is an alternating signal such as a sinusoidal signal or a pulse or pulse train signal.

Alternatively both signals can be AC signals of different frequencies. Alternative both signals can be pulse signals of different pulse width or of different pulse density. Alternatively the two signals can be a combination of two signals, each with any of the above signal properties. A selection of advantageous control signals is depicted in FIGS. 5*a–h*.

Advantageously at least one of the signals is of a frequency that will cause electrical or mechanical resonance of the micromechanical element $C_s$.

According to the invention a LC tank circuit is used to create a high amplitude oscillating current or charge on the capacitive micromechanical element for a transient period with a duration that is long enough to cause the change of the state of the bi-stable micromechanical element.

The invention can be applied for example to a micromechanical switch comprising a galvanic contact, micromechanical capacitive switches, bi-stable micromechanical capacitors and capacitor banks, micromechanical optical switches, or any capacitively controlled bi-stable or multi-state micromechanical actuator.

BRIEF DESCRIPTION OF THE DRAWINGS

FIGS. 5*a–h* illustrate waveforms used to control a micromechanical element, FIGS. 6*a–d* illustrate embodiments of the invention for controlling a micromechanical element.

FIGS. 1, 2 and 3*a–d* have already been explained when describing the background of the invention.

DETAILED DESCRIPTION OF THE INVENTION

In FIGS. 4*a–e* are illustrated the basic concepts of the invention, which are the core of the invention. In these Figures the capacitor $C_s$ describes a micromechanical element 402, such as a micromechanical switch or microrelay or such. The micromechanical element is controlled with a control signal or control signals. Typical waveforms of the control signal for controlling the micromechanical elements are illustrated in FIGS. 5*a–h*. The controlling can be understood as setting the micromechanical element into an active state, holding the micromechanical element at the active state and setting the micromechanical element into an inactive state.

Figure 5A:
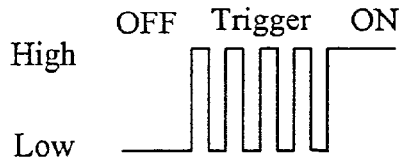
Figure 5B:
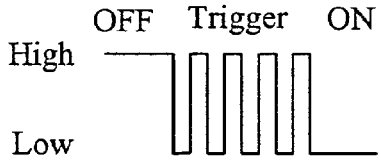
Figure 5C:
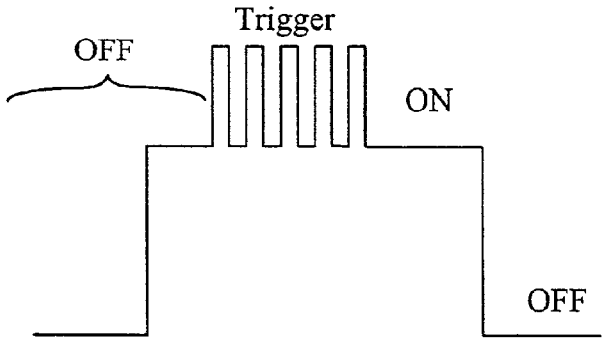

As can be seen from FIGS. 5*a* and 5*b*, the control signal can be a pulse train, which causes the micromechanical element to change its state. As well, in case of at least two control signals the signals can be combined in a superpositioned signal depicted in FIGS. 5*c* and 5*d*, in an amplitude modulated (AM) signal depicted in FIG. 5*e*, in a frequency modulated (FM) signal depicted in FIG. 5*f*, in a pulse width modulated (PWM) signal depicted in FIG. 5*g* or in a pulse density modulated (PDM) signal as depicted in FIG. 5*h*.

For a person skilled in the art it is obvious that the above described waveforms can be either sinusoidal or pulse formed or a combination thereof. For example, the trigger part of the waveform in FIG. 5*c* can advantageously be a sinusoidal signal instead of a pulse train. As well, a frequency swept waveform can be used according to the invention to control the micromechanical element.

According to the invention it is advantageous that the used control signal frequency is a sub-harmonic frequency of the mechanical resonance frequency of the micromechanical element. The control signal frequency can also be a sub-harmonic frequency of the electrical resonance circuit, which will be described later more closely.

In the case of at least two control signals $U_{trig}$ and $U_{hold}$ the basic idea is that by means of at least the second control signal $U_{trig}$ and the first control signal $U_{hold}$ the micromechanical element is arranged to change its state and by means of the second control signal $U_{hold}$ it is arranged to remain in its new state. Without any control signal the micromechanical element is arranged to return to the inactive state.

Figure 4A:
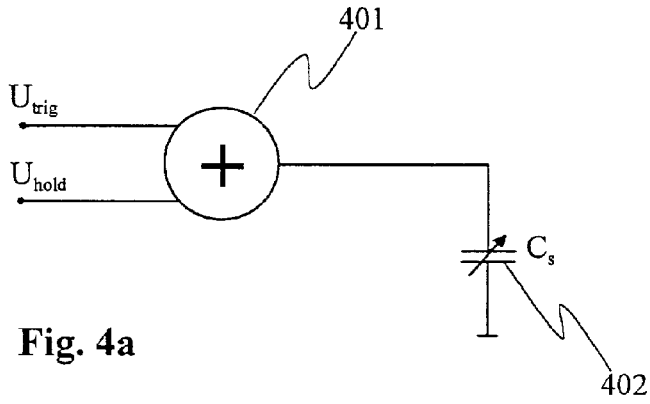
FIGS. 4*a–e* illustrate basic concepts of the invention.
Figure 4B:
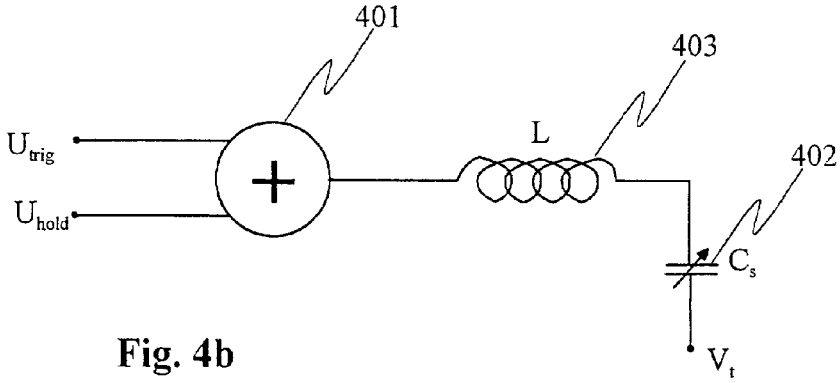
Figure 4C:
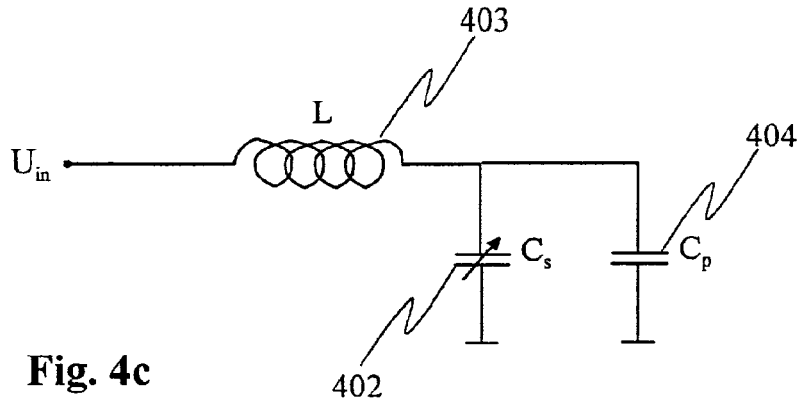
Figure 4D:
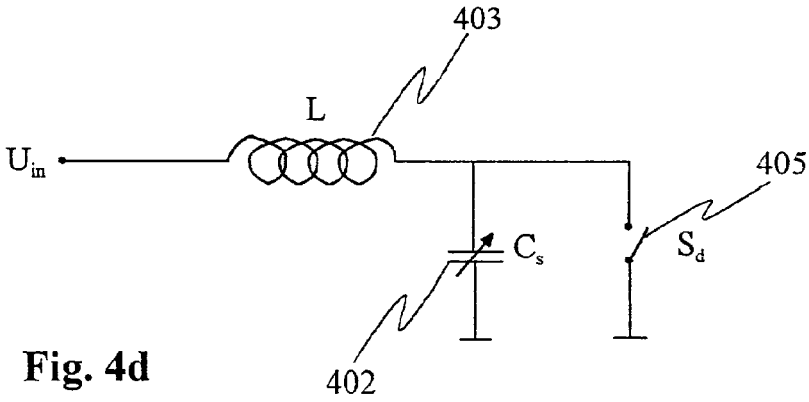
Figure 4E:
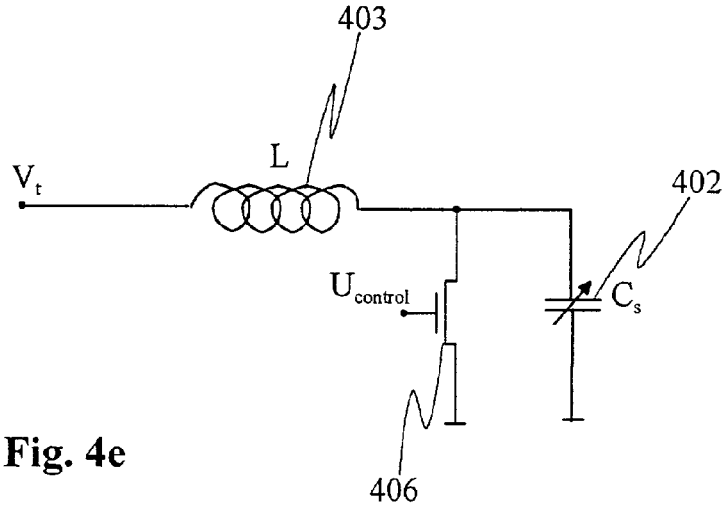
Figure 5D:
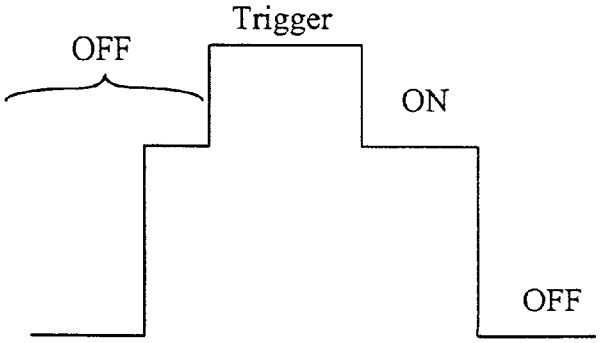

Next we consider the operation of the embodiments of the invention, shown in FIGS. 4*a–e*, keeping in mind the waveforms of the control signals, shown in FIGS. 5*a–h*. According to a first embodiment of the invention, illustrated in FIG. 4*a*, the operation is achieved by summing the first and the second control signal in the summing means 401. The sum of the control signals is arranged to exceed the level of pull-in voltage for $C_s$ resulting the micromechanical element 402 to change its state to pull-in state. The pull-in state can be held with just the first control signal $U_{hold}$, because the voltage needed to remain in the pull-in state is much lower than the voltage needed to achieve the pull-in. The advantage of the arrangement is that there is no need to apply a high voltage level to the micromechanical element during the whole pull-in period. As a result, electronics is simplified and the power consumption is reduced. An advantageous summed signal is depicted in FIG. 5*d*, but the signals can also be mechanically summed with an arrangement depicted in FIG. 10*a*, which will be discussed more closely later.

Figure 10A:
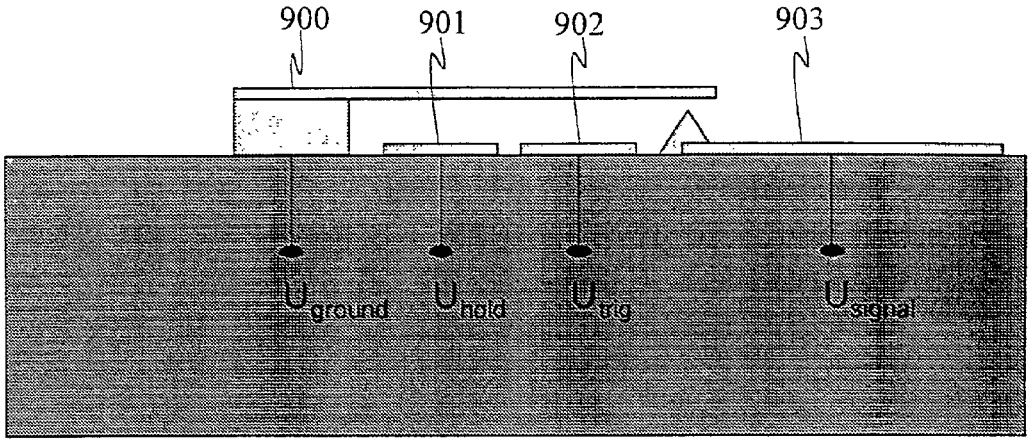
FIGS. 10*a–b* illustrate implementations of control electrodes on a substrate.

According to a second embodiment of the invention, which can be explained with FIG. 4*a*, the second control signal $U_{trig}$ alone is enough to cause the pull-in effect. In this case there is no need to sum the control signals. But it is advantageous to feed the first control signal $U_{hold}$ to the micromechanical element at least before the end of the $U_{trig}$ signal in order to preserve the pull-in state using $U_{hold}$ alone. In this case too the signals can be mechanically summed as depicted in FIG. 10*a*.

A third embodiment of the invention, illustrated in FIG. 4*b*, comprises a summing means 401, an inductance means 403 and a micromechanical element 402, again illustrated as a capacitor $C_s$. With the implementation as illustrated in FIG. 4*b* it is possible to generate a high amplitude voltage over the micromechanical element. To the summing means 401 it is fed a first control signal $U_{hold}$, which is for example a DC voltage signal, and a second control signal $U_{trig}$, which for example is a small amplitude high frequency sinusoidal signal or a pulse train.

The output of the summing element 401 is applied to a LC circuit 403, 402. This LC tank circuit is used to create a high amplitude oscillating current or charge through the capacitor because of resonance amplification of the output signal by the LC circuit. The LC-circuit comprises at least an inductor 403 of inductance L and a capacitance C. The capacitance C is advantageously the intrinsic capacitance $C_s$ of the micromechanical element. The capacitance can also be arranged as an external component to the micromechanical element, which can be understood that the capacitor is on the same substrate with the micromechanical element, but external to it, or even on a different substrate with the micromechanical element.

Figure 1A:
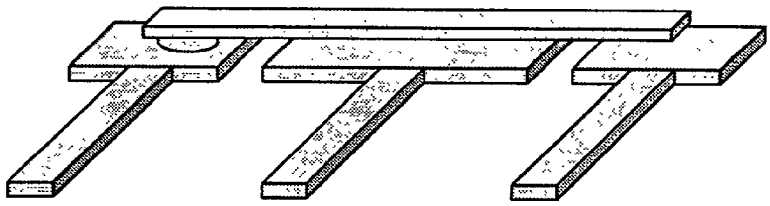
Fig. 1a PRIOR ART
FIGS. 1*a–c* illustrate various micromechanical switch structures.
Figure 1B:
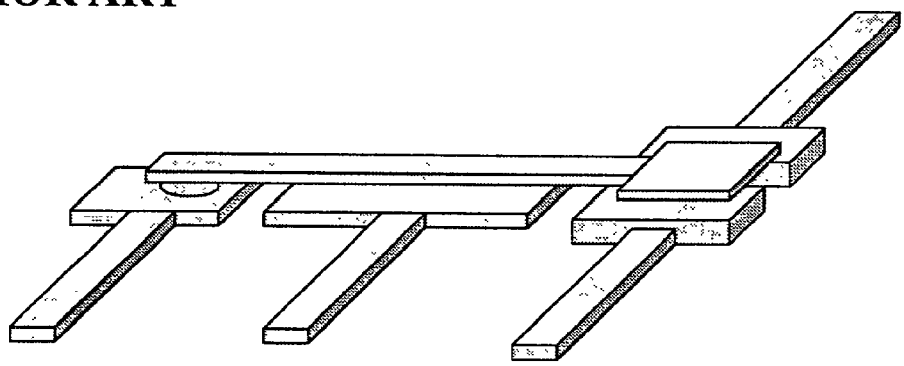
Fig. 1b PRIOR ART
Figure 1C:
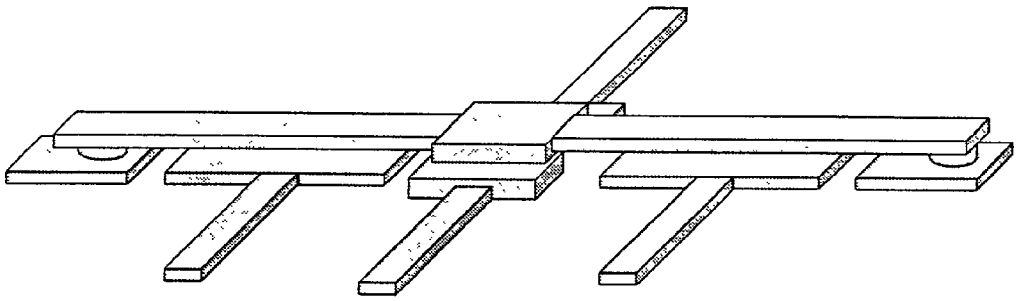
Fig. 1c PRIOR ART
Figure 2:
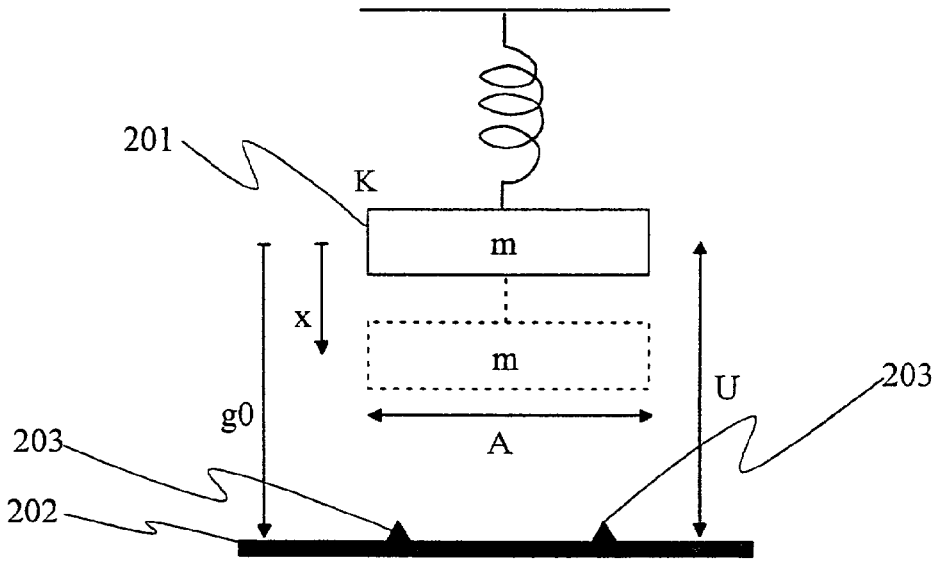
FIG. 2 illustrates a piston structure of a simplified micro electromechanical system.
Figure 3A:
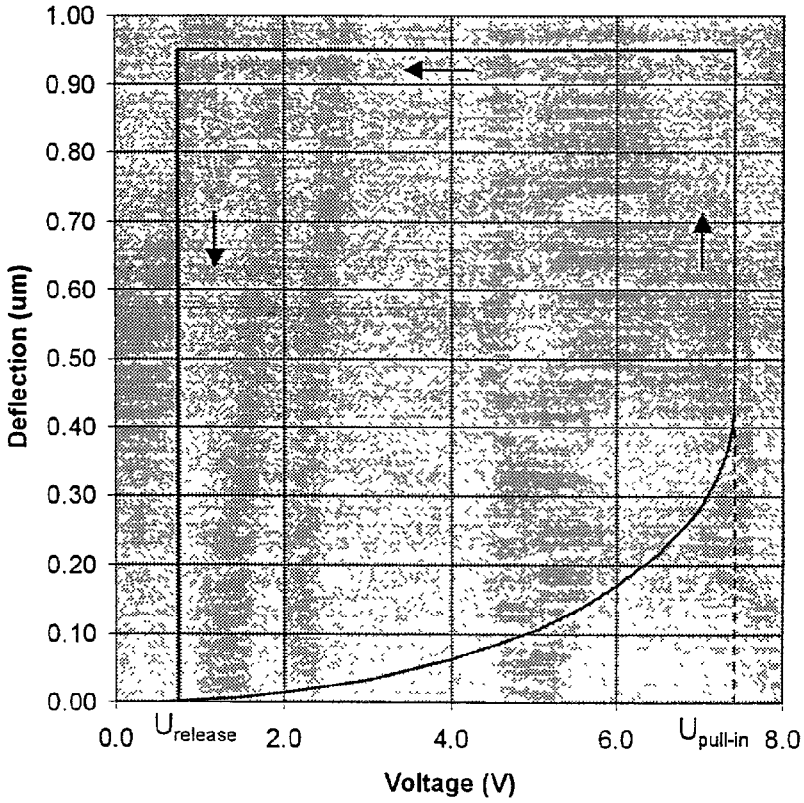
FIG. 3*a* illustrates typical voltage-to-deflection characteristics of a micromechanical capacitive element.
Figure 3B:
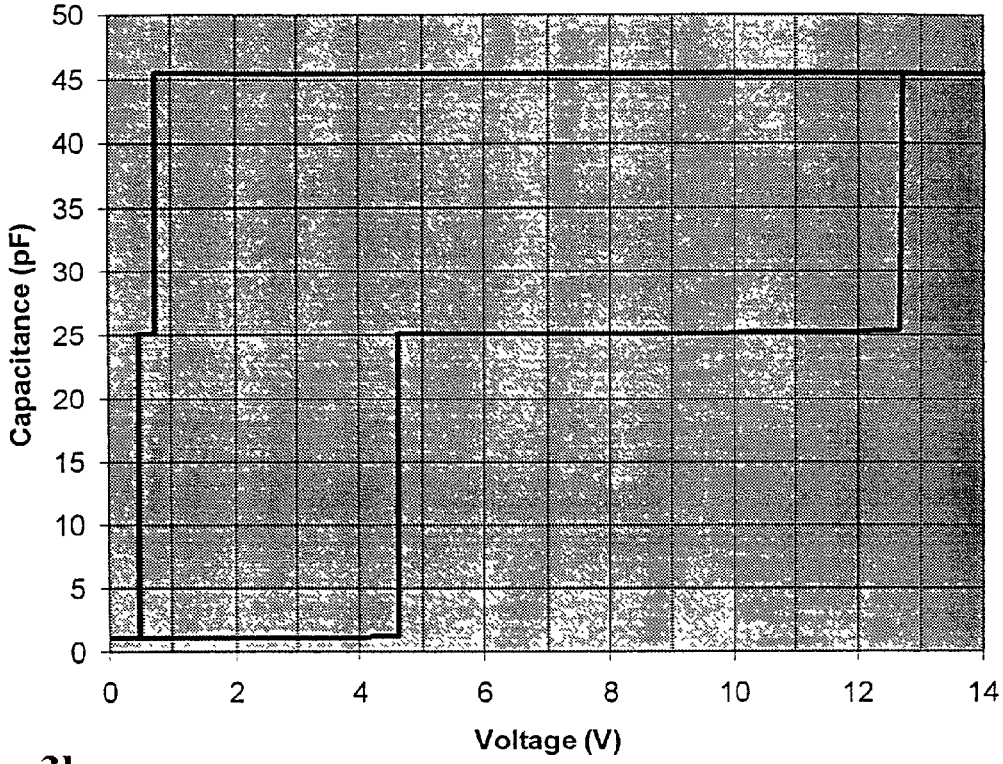
FIG. 3*b* illustrates voltage-to-capacitance characteristics of a three state capacitive structure.
Figure 3C:
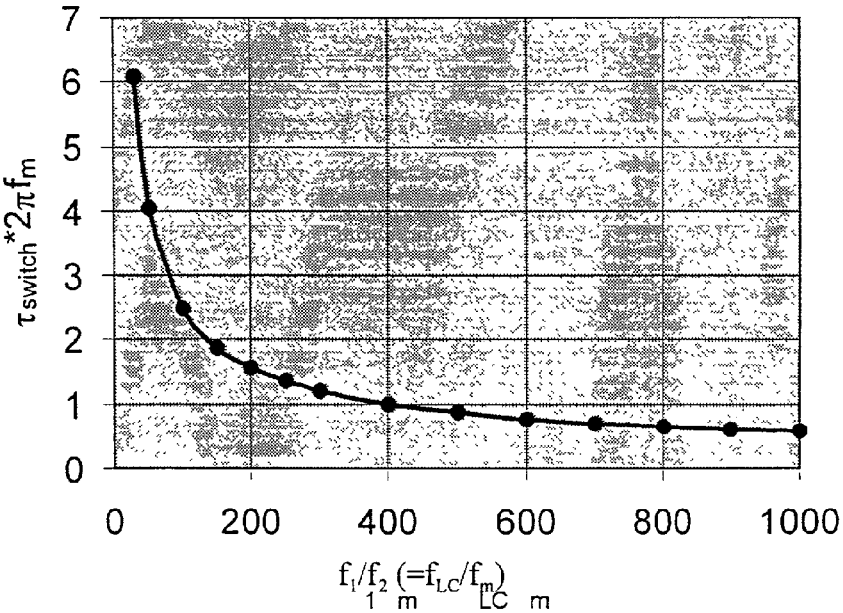
FIG. 3*c* illustrates the dependence of the switching delay on the ratio between the electrical or mechanical resonance frequencies to the signal frequency.
Figure 3D:
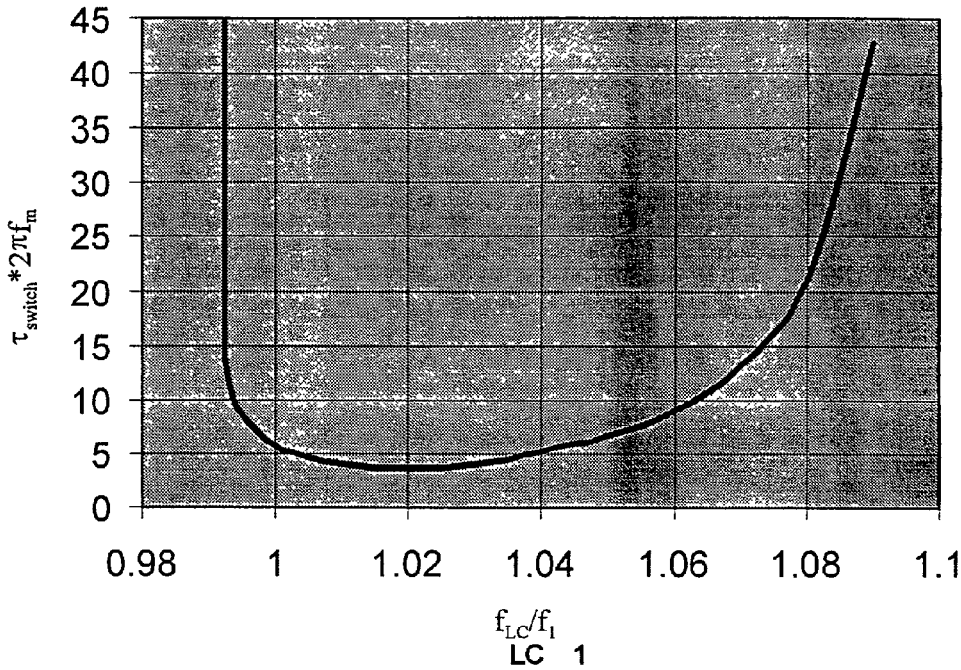
FIG. 3*d* illustrates the dependence of the switching delay on the ratio of the tank circuit resonance frequency and the control signal resonance frequency.

Advantageously, the frequency of the output signal from the summing element 401 is nearly the same as the resonance frequency of the LC-circuit that causes the amplification of the output signal. Optimally, the frequency of the output signal from the summing means 401 is 1–6% lower than the initial resonance frequency of the LC tank circuit, as shown in FIG. 3*c*, in order to have an optimum switching delay.

To a man skilled in the art it is obvious that the frequency of the output signal is determined by the frequency of the second control signal if the first control signal is a DC voltage signal.

It is also obvious to a person skilled in the art that a sub-harmonic frequency as well can be used as a control signal.

According to the invention the amplified output signal causes the change of state in the micromechanical element. Generally, by means of the LC-circuit the amplitude of the output AC signal or overlaid AC signal can be raised enough so that the required voltage level causing pull-in is reached. Taking advantage of the LC-circuit the AC voltage signal is converted into alternating charge in the switch capacitance. This charge will give rise to a unidirectional force component that makes the micromechanical element change its state. In the implementation shown in FIG. 4*a* the corresponding summed control signal is using ground as a terminating voltage. In the implementation shown in FIG. 4*b* the termination is arranged to be realized with a terminating voltage $V_t$. To a person skilled in the art it is obvious that the terminating voltage $V_t$ can be any suitable voltage like ground or the DC holding voltage. Further, it is obvious that this is applicable to all the other depicted circuits as well, although they are for reasons of clarity shown with ground as the terminating voltage.

A fourth embodiment of the invention, illustrated by FIG. 4*c*, comprises an inductor 403 and a capacitor 402 driven from the input terminal $U_{in}$. Additionally the depicted circuit comprises the additional capacitor 404 with the capacitance $C_p$ that can either be a purposefully added capacitor or any parasitic capacitance in the circuit. The capacitor 404 can be used in the LC circuit formed by L and the $C_s$+$C_p$ total capacitance when the circuit is arranged to resonate at a desired frequency.

FIG. 4*d* illustrates a fifth embodiment of the invention. The input signal $U_{in}$ both pulls in and holds the micromechanical element in the pull-in state until the signal $U_{in}$, is removed. The micromechanical element will however remain in the pull-in state for some time if there is any remaining charge on $C_s$. Switching means 405 are added to the previous circuit shown in FIG. 4*c* in order to discharge the remaining charge on the capacitor 402, which illustrates the micromechanical element, and thus speed up the switch-off time. The switch-off time is influenced by the voltage remaining between the plates of the capacitor 402, which is demonstrated as the trailing edge of the dimensionless deflection voltage in FIG. 12, which will be discussed more closely later. Discharging capacitor 402 with the help of the switch 405 will significantly reduce the switch-off delay of the micromechanical element 402.

FIG. 4*e* illustrates a sixth embodiment of the invention where the $U_{in}$ signal of the Previous embodiment is exchanged for a fixed DC voltage $V_t$, advantageously the holding voltage $V_{hold}$. A field effect transistor (FET) 406 is arranged to draw current supplied by $V_t$ through the inductor 403. The operation of the FET switch 406 can be controlled by inserting $U_{control}$ pulses to the gate of the FET 406. During triggering the FET 406 is pulsed at or near the resonance frequency of the LC combination causing the voltage over the capacitor plates to reach the necessary pull-in voltage. The DC holding voltage $V_t$ flowing through the inductor 403 is after triggering sufficient to keep the switch 402 in the active pull-in state. When $V_t$ is removed, the micromechanical element 402 releases.

Alternatively, if the voltage $V_t$ is not sufficient in itself to keep the micromechanical element 402 in the pull-in (active)

state, the voltage $V_t$ can be augmented by inserting short duration $U_{control}$ pulses to the gate of the FET 406 at a lower repetition rate or frequency. The advantage is that in this case the voltage $V_t$ needs not to be removed for the micromechanical element 402 to release.

Advantageously, the lower repetition frequency is a subharmonic of the electrical resonance frequency of the LC circuit formed in micromechanical element or the mechanical resonance frequency of the micromechanical element.

When it is desired to release the micromechanical element 402 from the pull-in state an additional brief pulse is advantageously arranged to be sent to the FET switch 406 in order to discharge the capacitance $C_s$ thus reducing the switch-off delay time.

FIG. 6*a* illustrates an embodiment of the invention comprising a controller 601 supplying a voltage or waveform 602, an inductance 403 and a micromechanical element 402. The controller supplies the $U_{in}$ signal 602 to drive a LC resonance circuit. The operation of the micromechanical element is the same as described in the fourth and fifth embodiments.

In a first practical embodiment relating to the implementation shown in FIG. 6*a* the controller 601 supplies the needed $U_{in}$ signal 602 for the micromechanical element. This embodiment is suitable for applications where the switch-off delay time is unimportant because the remaining charge of the micromechanical element $C_s$ must be discharged through the inductor, which slows down the operation cycle.

In a second practical embodiment relating to the implementation shown in FIG. 6*a* the controller 601 supplies the needed $U_{in}$ signal 602 for the micromechanical element but the controller 601 also controls a discharge control signal 603 for a discharge switch 405 in order to decrease the switch-off delay time.

Figure 6B:
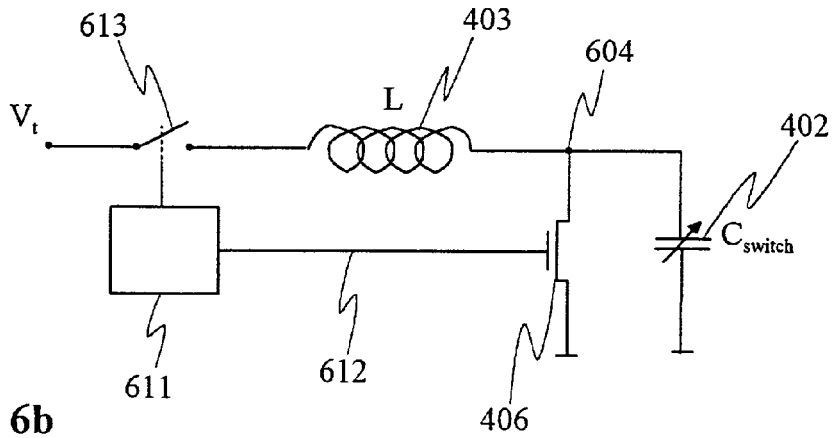

FIG. 6*b* illustrates an embodiment of the invention comprising a controller 611 controlling a supply switch 613 and also a high speed operating switch 406, preferably a FET switch. The semiconductor switch normally operates at a frequency causing electrical resonance in the serial resonance circuit formed by the inductor 403 and the capacitor 402. The operation principle of this circuit was earlier described when the sixth embodiment of the invention was introduced with referral to FIG. 4*e*.

In a first practical embodiment relating to the implementation shown in FIG. 6*b* the supply switch 613 is missing or can be considered to be continuously switched on. The controller 401 will in this case generate both the triggering signal and the hold signal from the supply signal by operating the switch 406 and using to advantage the supply $V_1$ and the electrical resonance of the LC circuit formed by the capacitor 402 and the inductor 403.

In a second practical embodiment relating to the implementation shown in FIG. 6*b* the controller 611 operates the supply switch 613 to switch off the supply. The supply voltage $U_{in}$ can in this case advantageously be a holding voltage $V_t$ just as shown in FIG. 6*b*. In this case the controller needs to operate the switch 406 and advantage the supply $V_t$ and the electrical resonance of the LC circuit formed by the capacitor 402 and the inductor 403 in order to generate the trigger voltage for the micromechanical element 402.

In a third practical embodiment relating to the implementation shown in FIG. 6*b* the operating switch 406 switches momentarily on after the supply switch has switched off or alternatively the supply is switched off while the operating switch 406 is still conducting. The operational switch thereby additionally operates as a discharge switch, as previously described, to minimize the switch-off delay of the micromechanical element $C_s$.

Figure 6C:
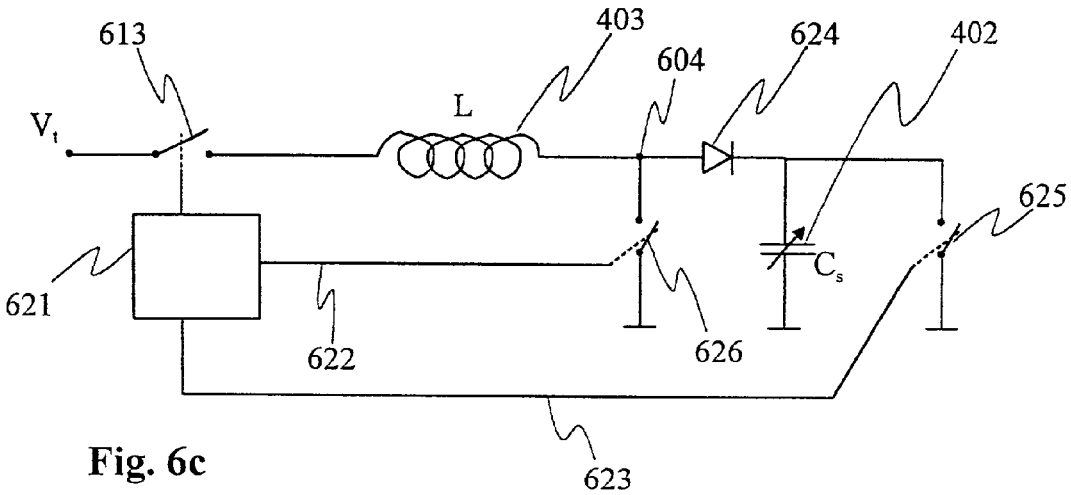

FIG. 6*c* illustrates an embodiment of the invention that does not use the previously demonstrated tank-circuit resonance to achieve the triggering voltage. The circuit according to FIG. 6*c* resembles a DC-to-DC converter or so called step up boost-converter. The voltage boosting circuit comprises a semiconductor switch 626 to draw current through the inductor 403 and a diode 634 to separate the load, which consists only of the micromechanical element 402. In a conventional DC-to-DC converter a relatively large reservoir capacitor would be used to collect charge, but in this embodiment the capacitance $C_s$ of the micromechanical element 402 comprises both load and reservoir capacitor. The DC-to-DC converter according to this embodiment needs only to generate the charge that is collected by the capacitance $C_s$ of the micromechanical switch and is thus very fast acting although it can be simple and of low power. The diode 624 prevents discharge through the converter. The first switching element 626 is thus used to boost the voltage up to the pull-in voltage needed for triggering. The second switching element 625 is used for discharging of the capacitive charge of the micromechanical element 402. This will advantageously only take place when the diode 624 is not conducting. The discharging is achieved by controlling the switching element 625 with the signal 623 so that the charge of the capacitor discharges to the ground.

In a first practical embodiment according to implementation shown in FIG. 6*c* the holding voltage is advantageously conducted through the inductor 403 and the diode 701 if a supply switch 613 controlled by the controller 621 is provided.

In a second practical embodiment according to implementation shown in FIG. 6*c* there is no supply switch 613 or it is not controlled by the controller 621 but continuously on. In this case the controller 621 needs to operate the switch 626 at a variable repetition rate or variable pulse width in order to generate both the trigger voltage and the holding for the micromechanical element 402.

Figure 6D:
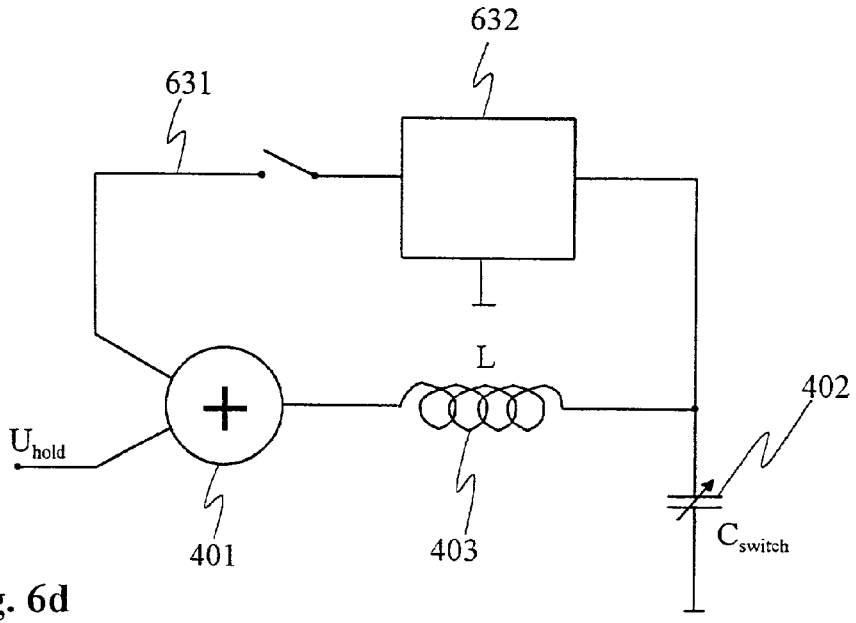

FIG. 6*d* illustrates an embodiment of the invention that instead of using an active controller uses a feedback network to induce self-resonance. The amplifying feedback phase shifting network causing self-resonance can be gated on or off with the signal 631 operated by the $U_{trig}$ control signal. The advantage with this embodiment is that there can be no frequency mismatch between driving signal frequency and the LC circuit resonance frequency.

In a first practical embodiment according to the implementation shown in FIG. 6*d* a single control signal is used to trigger the micromechanical element to pull-in. No holding voltage is in this embodiment provided. This method can be used where the efficiency of the implementation needs not be considered. The advantage is that a simple one-line control of the pull-in can be used. The disadvantage is that the pull-in voltage must be operated all the time in the active state because no separate hold voltage is provided.

In a second practical embodiment according to the implementation shown in FIG. 6*d* a separate control signal is used to provide the holding voltage and a separate control line is used to disconnect the positive feedback for the self-oscillation, which in this case will be needed only for the pull-in.

Figure 7A:
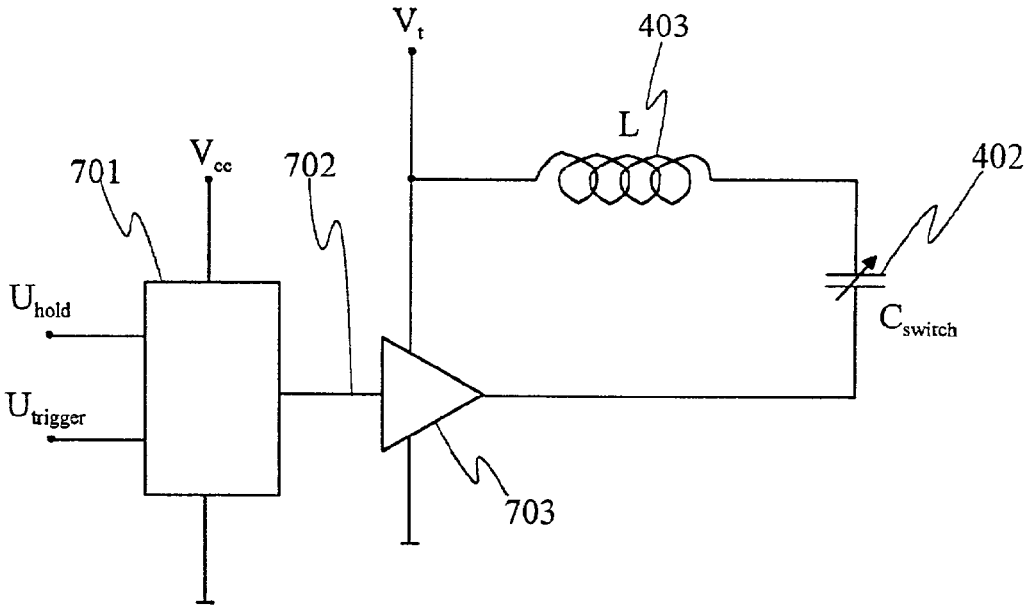
FIGS. 7*a–b* illustrate embodiments of the invention for controlling a micromechanical element.

FIG. 7*a* illustrates an embodiment of the invention comprising an amplifier stage 703 for driving the LC circuit 402 and 403 and a controller 701 having as inputs $U_{hold}$ and $U_{trig}$ and a supply voltage $V_{cc}$. The controller 701 controls the amplifier stage 703 with a single line 702. Advantageously, the holding voltage $V_t$ is also the supply voltage for the amplifier stage 703.

According to a first practical embodiment according to the implementation shown in FIG. 7*a* the amplifier 703 is controlled over the control line 702 using a control signal depicted for example in FIG. 5*b*. The control line 702 can thus either be held at the voltage level $V_T$ causing the micromechanical element 402 to remain in the active state, be idled at ground level causing the micromechanical element 402 to release or oscillate at or be held near the resonance frequency of the LC circuit 402, 403 causing pull-in of the micromechanical element 402.

According to a second practical embodiment relating to the implementation shown in FIG. 7*a*, the voltage $V_t$ is a lower voltage, preferably ground, than the other supply voltage $V_{cc}$ and the input signal to the amplifier is in this case a control signal depicted in FIG. 5*a*.

According to a third practical embodiment relating to the implementation shown in FIG. 7*a*, using a voltage $V_t$ that is not sufficient to sustain the micromechanical element in the pulled-in state, the controller 701 controls both the triggering voltage and the holding voltage over the control line 702 by using either amplitude modulated or pulse width modulated waveforms as depicted in FIG. 5*e* or 5*f*. The frequency of these waveforms, or a multiple of any of their subharmonic waveforms, are at or near the resonance frequency of the LC circuit 402, 403.

Figure 7B:
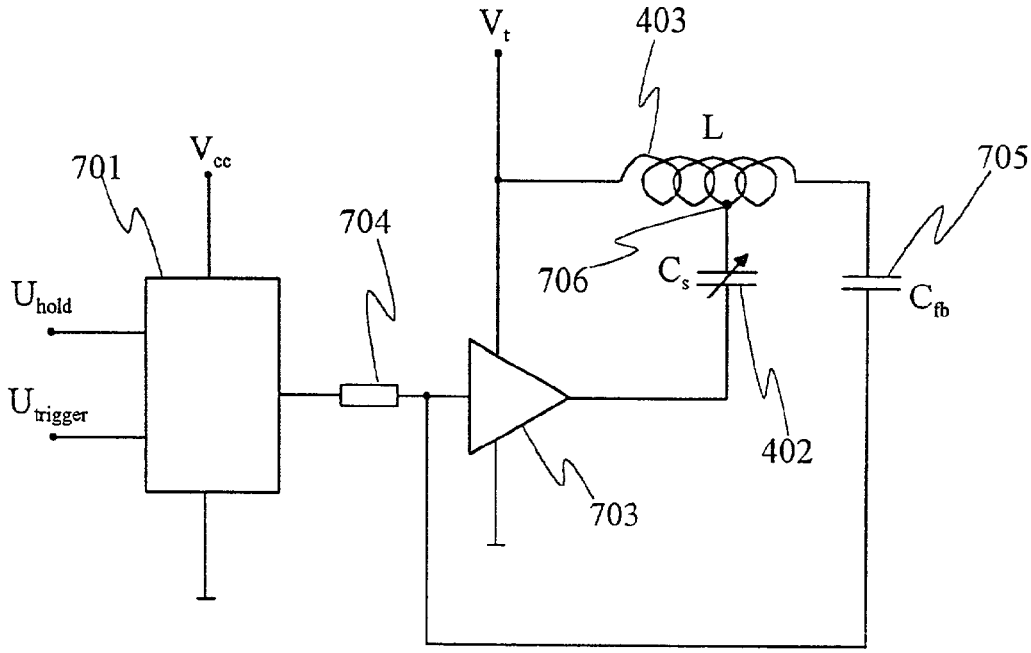

FIG. 7*b* illustrates an embodiment of the invention comprising a self-oscillating amplifier stage 703 driving the LC circuit 402, 403 and a controller 701 having inputs $U_{hold}$ and $U_{trig}$ and a supply voltage $V_{cc}$. A feedback path is arranged with the help of a feedback capacitor 705 from the inductor 403. The controller 701 controls the amplifier stage 703 with a single line 702. Advantageously, the holding voltage $V_t$ is also the supply voltage for the amplifier 703. A magnetically coupled coil or advantageously a tap 706 from the inductor 403 is arranged in order to provide a phase shifted feedback signal to be passed to the amplifier stage by the feedback capacitor 705. In FIG. 7*b* one end of the winding of the inductor 403 is connected to the supply voltage $V_t$ and the other end to the feedback capacitor $C_{fb}$ and the tap is connected to one electrode of the micromechanical element but it is obvious to a person skilled in the art that the tap can as well be connected to the supply voltage $V_t$ and the ends of the inductor 403 to the feedback capacitor $C_{fb}$ respective to the tank circuit capacitance $C_s$. The circuit according to FIG. 7*b* or the described variant thereof effectively forms the well-known Hartley oscillator and if the amplifier provides gain at the resonance frequency, the circuit will oscillate with components suitably selected.

In a first practical embodiment according to the implementation shown in FIG. 7*b* the controller 701 is unnecessary if a separate hold voltage need not be generated. The self-oscillation can be prevented simply by preventing the feedback signal to affect the amplifier 703 by grounding or otherwise stopping the feedback signal. The advantage is a simple one-line control but efficiency is reduced because the micromechanical element is unnecessarily pulled-in all the time even if a lower holding voltage would suffice.

In a second practical embodiment according to the implementation shown in FIG. 7*b* the controller 701 is arranged to provide a holding voltage as well. The self-oscillation generating the trigger voltage will only be active during the pull-in of the micromechanical element 402. The controller 701 provides the hold voltage by controlling the output amplifier to a suitable DC level while at the same time terminating the feedback signal needed to sustain the self-oscillation. A simple method to do this is indicated in FIG. 7*b* by using a high impedance control 704 that allows the feedback signal to reach the amplifier 703 when the output of the controller 701 is in a high impedance state. When the controller output is either high or low the feedback signal 704 is prevented from reaching the amplifier 703. One of the output levels controls the output of the amplifier to provide a DC holding voltage for the micromechanical element 402 and the other level, or the idling level, will cause the release of the micromechanical element. The advantage of this embodiment is that a full control of the micromechanical element can be obtained using only DC signal levels on only one signal line.

Figure 8A:
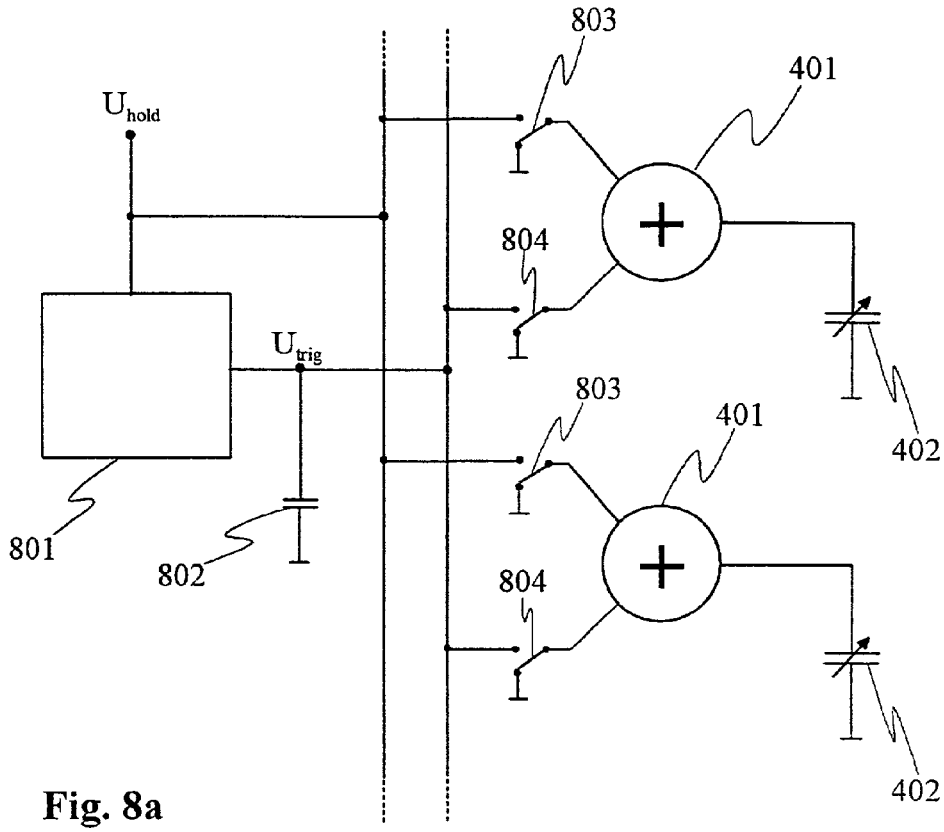
FIGS. 8*a–b* illustrate embodiments of the invention for controlling multiple micromechanical switches.
Figure 8B:
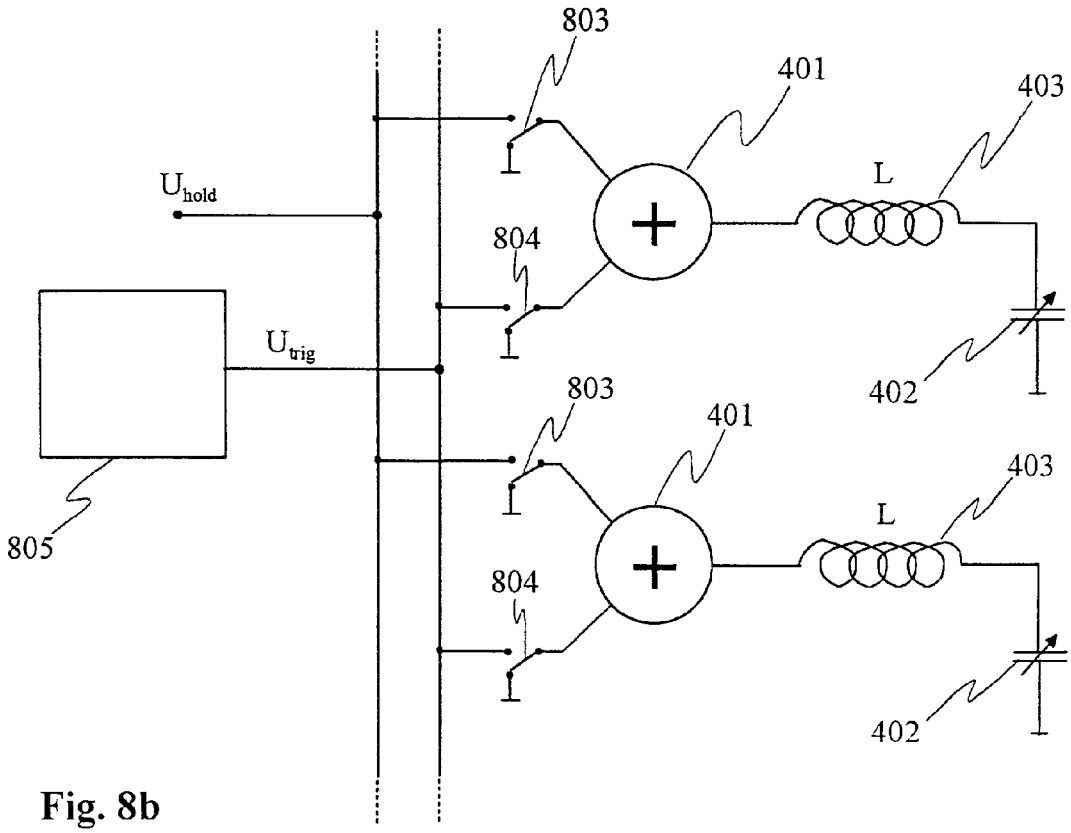

FIGS. 8*a*–*b* illustrates embodiments of the invention that can be used in situations, where several micromechanical elements 402 need to be controlled. In FIGS. 8*a*–*b* the micromechanical elements are illustrated as capacitors 402. The micromechanical elements are controlled by summing elements 401 into which a first control signal $U_{hold}$ and a second control signal $U_{trig}$ can be routed with the help of switches 803 and 804. The hold switch 803 can advantageously be arranged to provide the discharge function in order to speed up the release delay.

In a first practical embodiment relating to the implementation shown in FIG. 8*a* the second control signal $U_{trig}$ is formed from the first control signal $U_{hold}$ with a voltage converter means 801. One possibility is that the first control signal $U_{hold}$ is a DC voltage, which signal is DC-to-DC converted by the voltage converter means in order to generate the second control signal $U_{trig}$, which also is a DC voltage. The DC voltage level of the second control signal $U_{trig}$ is thus converted into a higher level than the voltage level of the first control signal $U_{hold}$. The second control signal $U_{trig}$ is collected in a reservoir capacitor 802, which is arranged between the output of the voltage converter means 801 and the ground. The selection of the control signals to the summing elements 401 are controlled with switching means 803, 804, which in this preferred embodiment are FET switches. The selection control of the first control signal $U_{hold}$ is realized with the switching means 803. In a similar manner the second control signal $U_{trig}$ is selected by the switching means 804. Advantageously, the signal controlling the switching means 804 is an AC voltage signal, which makes the switching means 804 alternate between the conducting state and the non-conducting state. Either the sum of the first control signal $U_{hold}$ and the second control signal $U_{trig}$ or the second control signal $U_{trig}$ alone pulls in the micromechanical element.

In a second practical embodiment according to the implementation shown in FIG. 8*b*, a separate $U_{trig}$ supply 805 is used. For a person skilled in the art it is obvious that the voltage converter means 805 can be a DC supply or some other converter. For example, it is possible to feed the summing elements 401 with any suitable DC or AC signal.

In FIGS. 8*a*–*b* there are only two micromechanical elements and control circuits shown, but for a person skilled in the art it is obvious that there can be any other number of these. The micromechanical elements can also differ from each other, which means that the required voltage level causing the pull-in effect can be different resulting in a need for either dissimilar converters or the use of different switch timing for the respective switches 803 and 804.

The above described embodiments have disclosed the control of the micromechanical elements. All the embodiments of the control circuits make use of electrical signals. In particular, most of the embodiments disclose implementations, which advantage the LC resonance in order to amplify the control signal effect. Another possibility in addition to using LC resonance to enhance the second control signal $U_{trig}$ is to advantage the mechanical resonance of the micromechanical element itself. This can be done by matching the harmonic frequency of the second control signal to the mechanical resonance of the micromechanical element structure. However, this requires a high Q value for the mechanical structure. In practice, this means that the micromechanical structure must operate in a vacuum in order to minimize disturbances.

Generally, it can be said that the arrangement for controlling a micromechanical element comprises at least means for generating at least a first control signal and a second control signal. These means can for example be voltage converter means. Even a battery is appropriate for this purpose. The arrangement according to the invention comprises means for raising a voltage level of at least the second control signal. The means can also be a common voltage converter circuit, especially in case where a certain voltage level is raised to a higher voltage level. Other possibility is that the means for raising a voltage level of at least the second control signal consists of an inductor and a capacitor forming a LC circuit. Here, it is possible to take advantage of the intrinsic capacitor of the micromechanical element. The inductor and the capacitor can also be discrete components. The arrangement according to the invention comprises additionally means for applying the first control signal and the second control signal with raised voltage level to the micromechanical element. These means are for example a summing circuit, which is used for summing the first control signal and the second control signal together and for feeding the sum of the signals to the micromechanical element. To a man skilled in the art it is obvious that the raise of the voltage level of at least the second control signal can be performed before or after the means for feeding the signals to the micromechanical element. This depends on the implementation of the control circuit.

Figure 9:
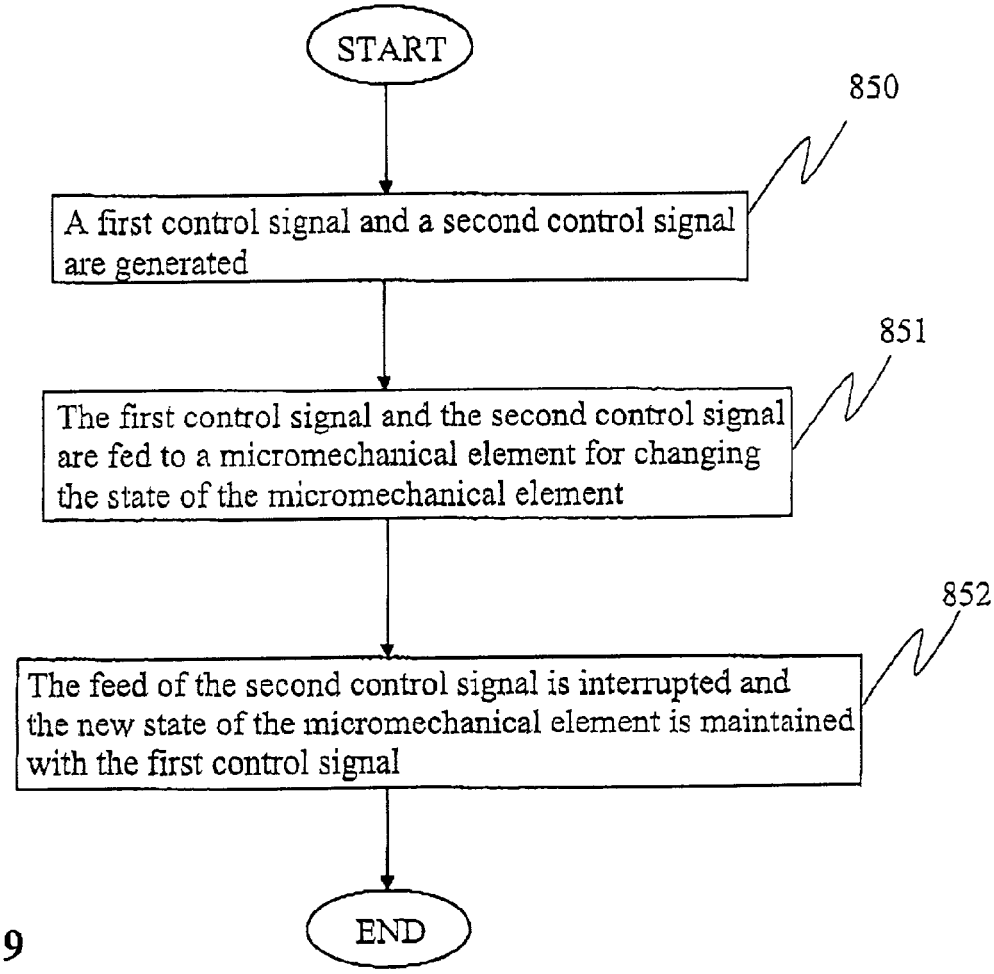
FIG. 9 illustrates a simplified flow diagram of the method according to the invention.

FIG. 9 illustrates with the help of a simplified flow diagram the method according to the invention. At the first stage 850 a first control signal $U_{hold}$ and a second control signal $U_{trig}$ are generated. The first control signal $U_{hold}$ can be generated for example directly from the supply voltage. The second control signal $U_{trig}$ can for example be generated from the first control signal $U_{hold}$. The first control signal $U_{hold}$ and the second control signal $U_{trig}$ are applied to a micromechanical element for changing the state of the micromechanical element in step 851. The new state is the triggered state of the micromechanical element or the pull-in state. According to a first embodiment of the invention the pull-in state is achieved with the second control signal $U_{trig}$ on its own. According to another embodiment of the invention the sum of the first control signal $U_{hold}$ and the second control signal $U^{trig}$ is needed to cause the pull-in effect in the micromechanical element. At the next stage 852 the feed of the second control signal $U_{trig}$ is interrupted and the new state of the micromechanical element is maintained with the first control signal $U_{hold}$. To a person skilled in the art it is obvious that the first control signal $U_{hold}$ has to be higher than the release voltage so that the pull-in state can be maintained. When deactivating the first control signal $U_{hold}$ the micromechanical element can be released to its original state. The first control signal $U_{hold}$ and the second control signal $U_{trig}$ can be amplified before applied to the micromechanical element. One possible way to perform the amplification is to use LC resonant circuit. Another possibility is to take advantage of the mechanical resonance of the micromechanical element. A buffer or amplifier can as well be used either to amplify control signals or to cause self-oscillation.

Figure 10B:
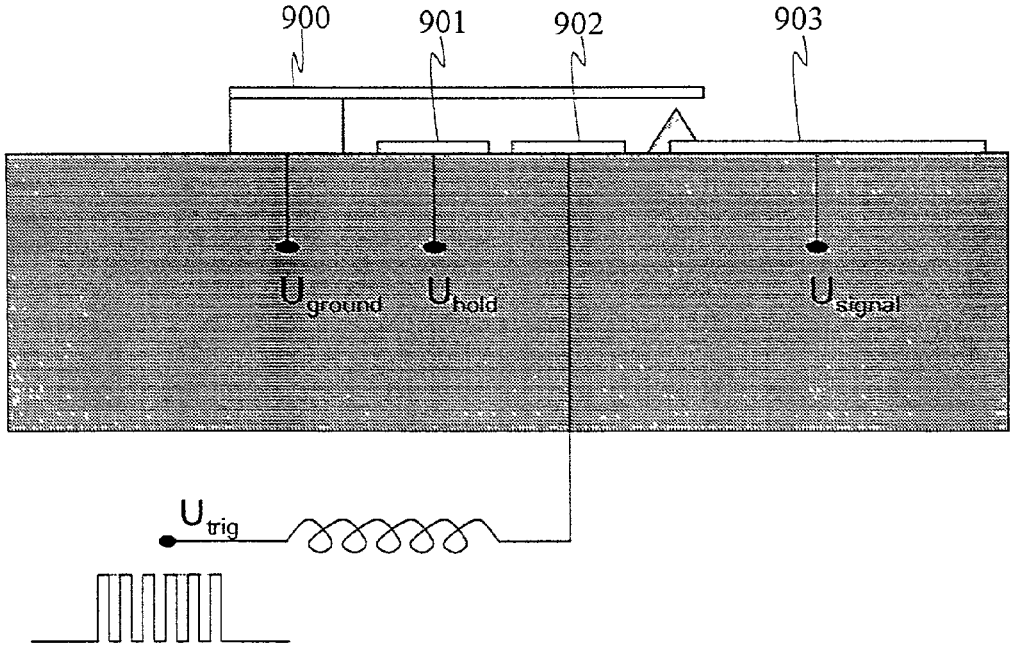

In FIGS. 10*a* and 10*b* it is illustrated practical implementations of the controlling arrangement implemented on a substrate. As can be seen from the FIGS. 10*a* and 10*b*, in these embodiments of the invention the electrodes 901, 902, which are used for applying two control signals to the micromechanical element 900, are separate from each other.

In FIG. 10*a* the micromechanical element 900, which here is a micromechanical switch, is arranged to change its state when feeding control signals to the electrodes 901, 902. According to the invention the first control signal $U_{hold}$ is arranged to the first electrode 901 and the second control signal $U_{trig}$ is arranged to the second electrode 902. The second control signal $U_{trig}$ is advantageously a short duration high voltage pulse, which is high enough to cause the pull-in effect with the first control signal $U_{hold}$. When the pull-in effect occurs the second control signal $U_{trig}$ can be deactivated and the pull-in state is thereafter maintained with the first control signal $U_{hold}$ only. The first control signal $U_{hold}$ and the second control signal $U_{trig}$ can also be fed to the micromechanical element by using the same electrode.

FIG. 10*b* illustrates the same kind of arrangement as shown in FIG. 10*a*. Here the short duration high voltage is achieved with a resonance circuit, which is arranged in the second control signal $U_{trig}$ circuit. The resonance circuit is formed with an inductor L and with the intrinsic capacitance of the micromechanical element. Advantageously, the frequency of the second control signal $U_{trig}$ is slightly (1–6%) higher than the resonance frequency of the resonance circuit. With the resonance circuit the voltage level of the second control signal $U_{trig}$ can be raised until it is high enough to cause the pull-in effect.

According to the invention the control electrodes are at least partly covered by a dielectric layer to prevent a galvanic contact between said control electrodes and the micromechanical element.

Figure 11:
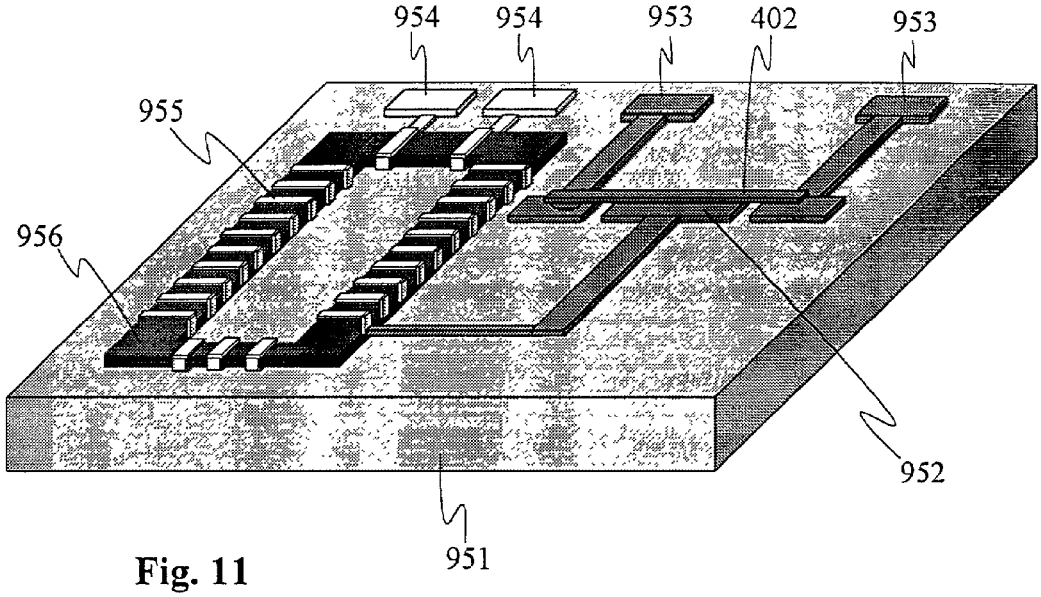
FIG. 11 illustrates an implementation of a LC circuit on a substrate.

FIG. 11 illustrates a practical layout of a micromechanical element. In this case a switch is depicted together with a toroidal inductance that provides the inductance of the resonating tank circuit where the capacitance $C_s$ of the control electrode together with stray capacitances forms the total capacitance of the LC circuit. The toroidal inductance is advantageously arranged to have a magnetic core in order to reduce its size and to reduce the leak inductance.

FIG. 11 illustrates such an embodiment where the toroidal inductance and the micromechanical element are integrated on the same substrate 951. The arrangement shown in FIG. 11 contains a micromechanical element 402, signal pads 953 and a control electrode 952. In this preferred embodiment it is arranged only one control electrode 952 for controlling the operation of the micromechanical element 402. According to the invention it is also possible to use multiple electrodes for controlling purposes. The control signals are applied to the substrate through control signal pads 954. The signals are applied to the micromechanical element 402 through a toroidal inductance 955. The toroidal inductance 955 is advantageously arranged around a magnetic core 956. By means of the inductor 955 and the intrinsic capacitance of the micromechanical element 402 the voltage level of the control signals can be raised to a required voltage level to cause the pull-in effect, as described earlier. The substrate 951 can be a silicon wafer on which the micromechanical element 402 and the inductor 955 are integrated. One possibility is to use borosilicate glass as a substrate. The substrate can also be made of polymer. The inductor used is advantageously a three dimensional solenoid or toroid arranged around a magnetic core. Advantageously, the magnetic core 956 has a high permittivity. It is also possible that the inductor 955 and the micromechanical element 402 are not integrated on the same substrate. According to this embodiment the inductor is a bulk component, which is external to the micromechanical element.

When the invention is applied to micromechanical switches with the inductor integrated on the same substrate the practical inductance values for the inductor will be in the order of 100 nH to 10 000 nH and the Q factor will need to be better than 10 in the frequency range from 1 to 200 MHz. The mechanical resonance Q factor is depending on the desired switching time but will be in the order of 0.01 to 0.5.

Figure 12:
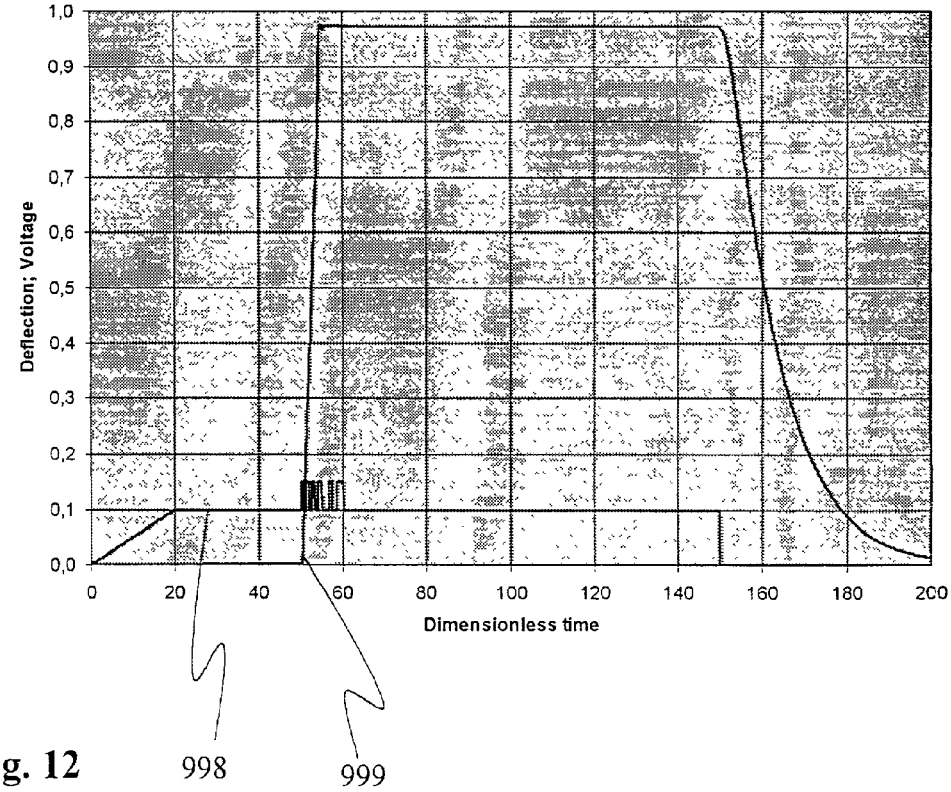
FIG. 12 illustrates a transient simulation of the operation of a micromechanical element.

FIG. 12 illustrates a transient simulation of the deflection of a micromechanical element structure, which in this case is a switch. The x-axis is the time scale, which is dimensionless and the y-axis shows the deflection of the structure and the corresponding pull-in voltage. The first graph 998 describes the sum of the first and the second control signals. The second graph 999 illustrates the deflection of the micromechanical switch. The voltage is first ramped to the voltage level of the first control signal, which is the hold voltage. At a time instant 50 the second control signal is fed to the electrodes resulting in the pull-in effect of the micromechanical element. The second control signal is activated at about 10 time units. The pull-in state is held with the first control signal until the time instant 150. As can be seen, with the arrangement according to the invention, the pull-in state can be held with a low voltage level that is only a tenth of the pull-in voltage.

In the description it has been shown different kinds of arrangement by means of which the operation of the micromechanical elements, such as switches, can be controlled. So far it has not been paid attention to the practical values of components and elements, which are used. For clarifying the technical features of the arrangement the micromechanical switch can for example be such that its mechanical resonance frequency $f_0$ is from 10 to 200 kHz. The mechanical quality factor $Q_m$ is between 0.05 and 0.5. The pull-in voltage $U_{pull\text{-}in}$ is 10–30 V and the intrinsic capacitance of the micromechanical switch is 1–30 pF. The inductance of the inductor used can advantageously be 100 nH–10 μH. The quality factor Q of the LC tank circuit is advantageously larger than 10 and the resonance frequency $f_{LC}$ of the tank circuit is 1–200 MHz. The AC voltage source used for producing the second control signal $U_{trig}$ has amplitude, which is about 0.1–0.2 times the pull-in voltage $U_{pull\text{-}in}$. Typically, this is something like 1–3 V. The frequency of the AC signal is from 1 to 200 MHz. The DC voltage source for producing the first control signal produces a voltage the amplitude of which is 0.1–0.2 times the pull-in voltage $U_{pull\text{-}in}$, typically it is 1–3 V. To a person skilled in the art it is obvious that the values shown above are only examples and do not restrict the invention anyhow.

The control of micromechanical elements is advantageously carried out using low voltage in order to reduce the complexity and thus the price. New inventive and practical solutions for the control of micromechanical elements have been presented here. These micromechanical elements can be switches, relays or any other kind of micromechanical elements for electrical and optical switching purposes.

Micromechanical elements are today used for many purposes in the field of telecommunications. For example, micromechanical elements are used in mobile stations, where switching is needed for many purposes especially in dual band or dual mode mobile stations.

In the implementations that have been described the components and means can be replaced with other elements performing essentially the same operations.

The invention has been explained above with reference to the aforementioned embodiments. However, it is clear that the invention is not restricted only to these embodiments, but comprises all possible embodiments within the spirit and scope of the inventive thought and the following patent claims.

The invention claimed is:

1. A method for controlling at least one micromechanical element, wherein the micromechanical element is set to an active state with a sum of a first control signal and a second control signal, and the micromechanical element is held on said active state with at least the first control signal, and wherein the sum of the first control signal and the second control signal is fed to the micromechanical element with at least one control electrode, the at least one control electrode being at least partly covered by a dielectric layer to prevent a galvanic contact between said control electrode and the micromechanical element.

2. A method according to claim 1, characterized in that the active state is a pull-in state.

3. A method according to claim 1, characterized in that the second control signal is a short duration voltage pulse.

4. A method according to claim 1, characterized in that the second control signal is a short duration sinusoidal signal.

5. A method according to claim 1, characterized in that the second control signal is a short duration pulse train.

6. A method according to claim 1, characterized in that the second control signal is a frequency swept waveform.

7. A method according to claim 1, characterized in that the first control signal is a constant voltage signal.

8. A method according to claim 1, characterized in that the sum consists of signals with different amplitudes.

9. A method for controlling at least one micromechanical element, wherein the micromechanical element is set to an active state with a sum of a first control signal and a second control signal, said sum consisting of signals with different frequencies, and the micromechanical element is held on said active state with at least the first control signal.

10. A method for controlling at least one micromechanical element, wherein the micromechanical element is set to an active state with a sum of a first control signal and a second signal, the sum consisting of signals with different duty cycles, and the micromechanical element is held on said active state with at least the first control signal.

11. A method for controlling at least one micromechanical element, wherein the micromechanical element is set to an active state with a sum of a first control signal and a second control signal, the sum consisting of signals with different pulse densities, and the micromechanical element is held on said active state with at least the first control signal.

12. A method for controlling at least one mechanical element, wherein the micromechanical element is set to an active state with a sum of a first control signal and a second control signal, wherein the amplitude of the second control signal is raised with a resonance circuit higher than an amplitude of the first control signal, and the micromechanical element is held on said active state with at least the first control signal.

13. A method according to claim 12, characterized in that a frequency of the second control signal is 0–6% lower than an electrical resonance frequency of the resonance circuit.

14. A method for controlling at least one micromechanical element, wherein the micromechanical element is set to an active state with a sum of a first control signal and a second control signal, the micromechanical element is held on said active state with at least the first control signal, and a harmonic frequency of the second control signal is essentially the same as a resonance frequency of the micromechanical element.

15. A method according to claim 14, characterized in that a harmonic frequency of the second control signal is essentially the same as an electrical resonance of the micromechanical element.

16. A method according to claim 14, characterized in that a harmonic frequency of the second control signal is essentially the same as a mechanical resonance of the micromechanical element.

17. An arrangement for controlling at least one micromechanical element, wherein the arrangement comprises:

means for generating at least a first control signal and a second control signal;

means for raising a voltage level of at least the second control signal;

means for feeding the sum of the first control signal and the second control signal with raised voltage level to the micromechanical element; and wherein means for feeding the sum of the first control signal and the second control signal to the micromechanical element contains at least one control electrode, wherein the at least one control electrode is at least partly covered by a dielectric layer to prevent a galvanic contact between said control electrodes and the micromechanical element.

18. An arrangement according to claim 17, wherein means for generating at least the first control signal and the second control signal contain at least a voltage converter circuit.

19. An arrangement according to claim 17, wherein the arrangement contains at least an inductor connected to a DC voltage source, a micromechanical element with an intrinsic capacitance, a diode for preventing discharging of said capacitor of said micromechanical element, a first switching element for controlling a voltage between said inductor and said diode, a second switching element (803) for resetting said charge of said capacitance (402) of said micromechanical element.

20. An arrangement according to claim 17, wherein means for raising a voltage level of at least said second control signal contain at least a resonance circuit.

21. An arrangement according to claim 20, characterized in that the resonance circuit consists of an inductor and a capacitance of the micromechanical element.

22. An arrangement according to claim 21, characterized in that the capacitance is intrinsic to the micromechanical element.

23. An arrangement according to claim 21, characterized in that the capacitance is external to the micromechanical element.

24. An arrangement according to claim 21, characterized in that the inductor and the micromechanical element are integrated on the same substrate.

25. An arrangement according to claim 24, characterized in that the substrate is a silicon wafer.

26. An arrangement according to claim 24, characterized in that the substrate is made of borosilicate glass.

27. An arrangement according to claim 24, characterized in that the substrate is made of quartz.

28. An arrangement according to claim 24, characterized in that the substrate is made of polymer.

29. An arrangement according to claim 21, characterized in that the inductor is a three dimensional solenoid.

30. An arrangement according to claim 21, characterized in that the inductor is a three dimensional toroid.

31. An arrangement according to claim 21, characterized in that the inductor has a high permittivity core.

32. An arrangement according to claim 21, characterized in that the inductor is a bulk component external to the micromechanical element.

33. An arrangement according to claim 20, characterized in that the resonance circuit contains at least, an inductor connected to a DC voltage source, a micromechanical element with an intrinsic capacitance, a switching element to control for discharging said intrinsic capacitance of said micromechanical element.

34. An arrangement according to claim 20, characterized in that the resonance circuit is driven by an amplifier stage.

35. An arrangement according to claim 34, characterized in that the amplifier stage is controlled with a feedback signal from the resonance circuit.

36. An arrangement according to claim 17, wherein the means for feeding the first control signal and the second control signal with raised voltage level to the micromechanical element contain a summing element for summing said first control signal and said second control signal.

37. An arrangement according to claim 17, wherein means for feeding the first control signal and the second control signal to the micromechanical element contain at least two separate control electrodes for said first and said second control signals.

38. An arrangement for controlling at least one micromechanical element, wherein the arrangement comprises:

means for generating at least a first control signal and a second control signal, wherein the means for generating at least the first control signal and the second control signal contain at least a voltage converter circuit;

means for raising a voltage level of at least said second control signal;

means for feeding the sum of said first control signal and said second control signal with raised voltage level to the micromechanical element;

an inductor connected to a DC voltage source;

a micromechanical element with an intrinsic capacitance;

a diode for preventing discharging of said capacitor of said micromechanical element;

a first switching element for controlling a voltage between said inductor and said diode; and a second switching element (803) for resetting said charge of said capacitance (402) of said micromechanical element.

* * * * *